US007047777B2

(12) United States Patent
Banks

(10) Patent No.: US 7,047,777 B2
(45) Date of Patent: May 23, 2006

(54) KEY WITH TRANSPONDER AND ROTATING SHUTTLE

(75) Inventor: David C. Banks, Johnson City, TN (US)

(73) Assignee: Hurd Corporation, Greenville, TN (US)

( * ) Notice: Subject to any disclaimer, the term of this patent is extended or adjusted under 35 U.S.C. 154(b) by 0 days.

(21) Appl. No.: 10/827,641

(22) Filed: Apr. 19, 2004

(65) Prior Publication Data

US 2005/0229662 A1 Oct. 20, 2005

(51) Int. Cl.
*E05B 19/04* (2006.01)

(52) U.S. Cl. ..... 70/408; 70/278.3; 70/395; 340/5.6

(58) Field of Classification Search ..... 70/408, 70/405, 395, 278.3, 413; 340/5.6, 5.61, 5.64, 340/5.65

See application file for complete search history.

(56) References Cited

U.S. PATENT DOCUMENTS 3,841,120 A * 10/1974 Gartner ..... 70/408
4,562,712 A * 1/1986 Wolter ..... 70/408
5,732,579 A * 3/1998 D'Hont et al. ..... 70/408
5,775,148 A * 7/1998 Layton et al. ..... 70/408
5,832,761 A * 11/1998 Chen ..... 70/408
5,974,844 A * 11/1999 Harrelson et al. ..... 70/408
6,094,954 A * 8/2000 Carmen ..... 70/408
6,308,542 B1 * 10/2001 Bolton ..... 70/408
6,457,337 B1 * 10/2002 Hattick et al. ..... 70/278.3
6,601,421 B1 * 8/2003 Chaillie ..... 70/408
6,609,402 B1 * 8/2003 Blankenship et al. ..... 70/408
6,637,245 B1 * 10/2003 Bolton ..... 70/408
2003/0209044 A1 * 11/2003 Plate et al. ..... 70/408

* cited by examiner

*Primary Examiner*—Brian E. Glessner
*Assistant Examiner*—Christopher Boswell
(74) *Attorney, Agent, or Firm*—Luedeka, Neely & Graham, P.C.

(57) ABSTRACT

A key assembly which includes a key shank having a forward portion and a handle portion having an aperture. A shuttle is also included. The shuttle includes first and second substantially planar portions and a center portion connected to the substantially planar portions. A transponder recess is located on the shuttle. The shuttle is configured and dimensioned to mate with the aperture on the handle portion of the key shank. After mating with the aperture, the shuttle rotates within the aperture. After mating with and rotating within the aperture, the shuttle is securely retained within the aperture. A transponder is located within the transponder recess. The transponder receives a wireless interrogation signal and transmitting a wireless response signal in response to the interrogation signal. A key head is formed about the shuttle, transponder, and handle portion of the key shank.

21 Claims, 9 Drawing Sheets

KEY WITH TRANSPONDER AND ROTATING SHUTTLE

FIELD

This invention relates to the field of keys for a lock. More particularly, this invention relates to keys for a motor vehicle system that is secured by an electronic interlock.

BACKGROUND

To inhibit the unauthorized use of motor vehicles, various types of electronic interlocks have been developed and incorporated into the ignition system of vehicles. One such system, commonly referred to as PATS (Passive Anti-Theft System), utilizes a transponder embedded in the ignition key. When the key is inserted in the ignition, the vehicle ignition system generates an electromagnetic field which energizes the transponder in the key. The transponder then transmits a coded wireless signal which is received by the vehicle ignition system and decoded. If the decoded signal meets the criteria for a valid signal, the vehicle ignition system allows the vehicle engine to be started. If the decoded signal is determined to be invalid, the vehicle ignition system will prevent the engine from being started.

A variety of manufacturing difficulties have surfaced in the production of PATS keys due to the difficulty associated with incorporating a transponder into the limited amount of space occupied by a key. For example, since the orientation of the transponder within the key is important to proper operation of the electronic interlock, the manufacturing method employed should ensure a consistently accurate placement of the transponder within the key. Some transponders are encased within a glass enclosure that is susceptible to damage when exposed to mechanical shock, so consideration should be given to ensuring the survivability of the transponder after it has been formed within the key. One prior art approach to protecting the transponder and increasing its operational reliability has been to wrap a shock absorbing sleeve around the glass encased transponder before molding the transponder into the key. However, this additional manufacturing procedure increases the cost of the key. Costs and ease of manufacturability are other factors which should be considered, particularly given the fact that such keys are typically mass produced. Unfortunately, prior art approaches associated with the design and manufacture of PATS keys have been less than optimal.

Therefore, there is a need for a PATS key design and associate method of manufacture that improves upon prior art approaches.

SUMMARY

The above and other needs are met by a key assembly which includes a key shank having a forward portion and a handle portion having an aperture. A shuttle is also included. The shuttle includes first and second substantially planar portions and a center portion connected to the substantially planar portions. A transponder recess is located on the shuttle, and a transponder is located within the transponder recess. The shuttle is configured and dimensioned to mate with an aperture on the handle portion of the key shank. After mating with the aperture, the shuttle rotates within the aperture. After mating with and rotating within the aperture, the shuttle is securely retained within the aperture. The transponder may receive a wireless interrogation signal and transmit a wireless response signal in response to the interrogation signal. A key head is formed about the shuttle, transponder, and handle portion of the key shank. The key head may be a polymeric material.

In one embodiment, the first and second substantially planar portions are substantially circular. The first substantially planar portion includes a flange extending outwardly from its perimeter and the second substantially planar portion includes keyed projections extending outwardly from the perimeter. The keyed projections mate with slots on the aperture to properly orient the shuttle within the aperture. The central portion of the shuttle includes a rotation stop to correctly position the shuttle when it is rotated within the aperture and a locking projection to hold the shuttle in correct position.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

With reference now to the drawings, FIGS. 1–4 illustrate a vehicle key for use in a vehicle lock having an electronic interlock system in accordance with a preferred embodiment of the invention. An electronic interlock vehicle ignition system suitable for use with the key 10 is described in U.S. Pat. No. 5,433,096 entitled "Key Assembly For Vehicle Ignition Locks."

Figure 1:
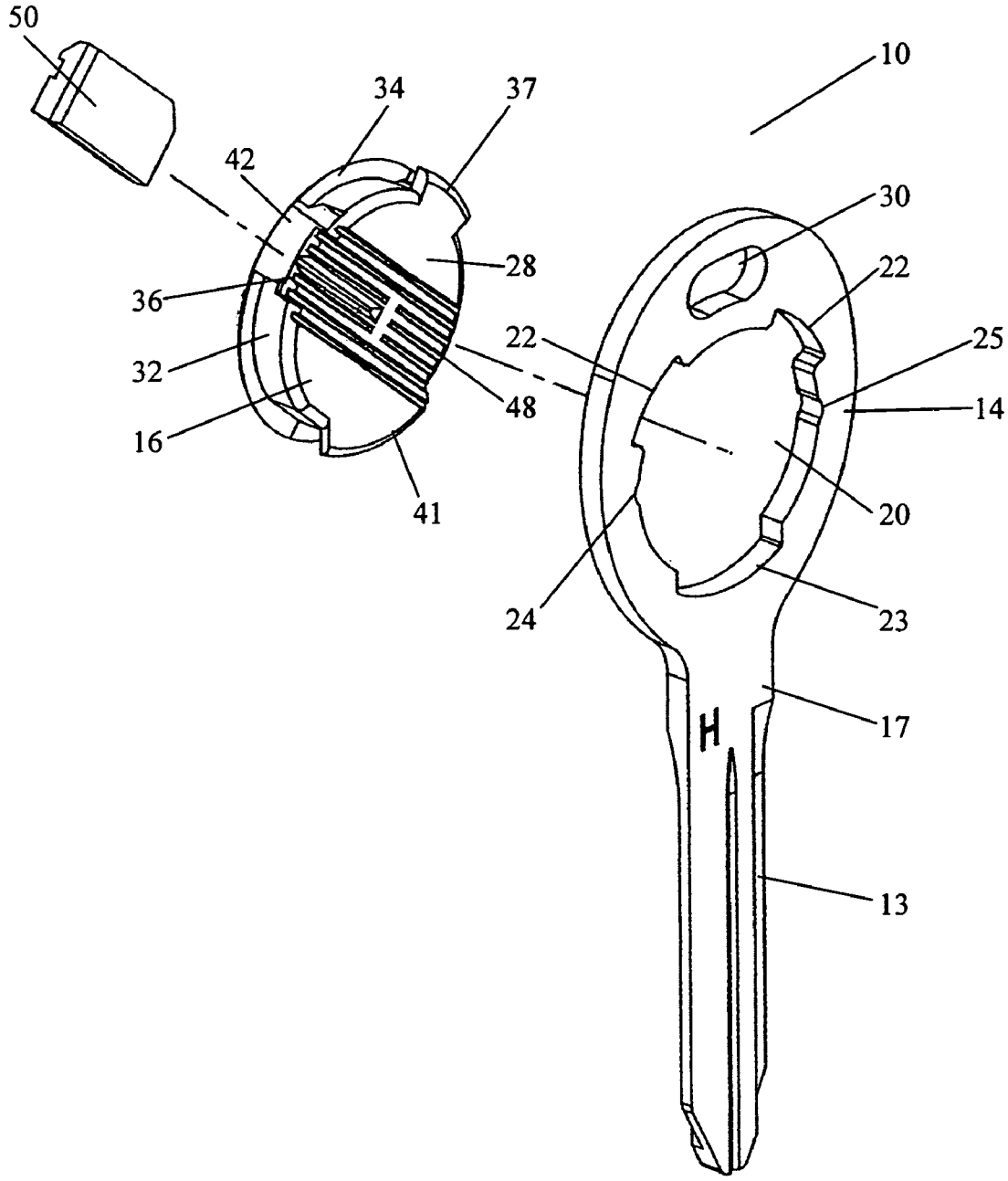
FIG. 1 is an exploded view of a key assembly without a key head in accordance with a preferred embodiment of the invention.
Figure 2:
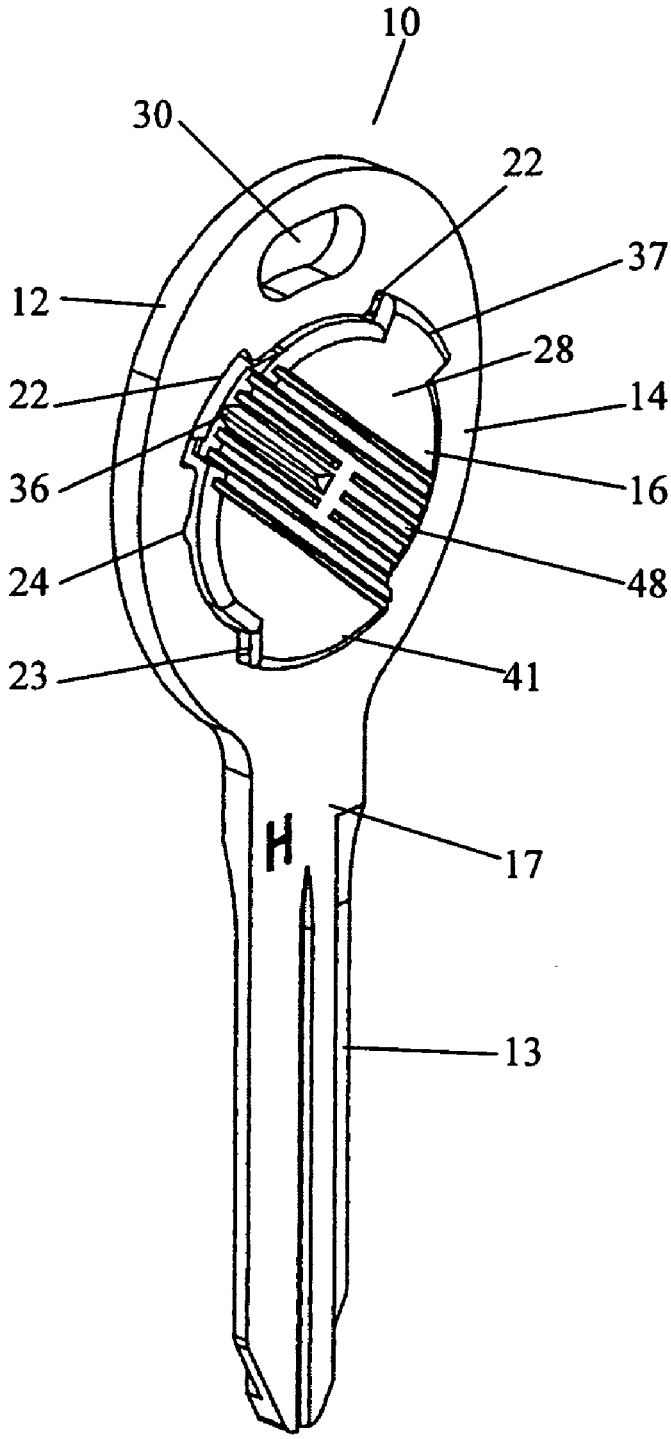
FIG. 2 is a perspective view of a shuttle inserted within the key shank aperture in accordance with a preferred embodiment of the invention.
Figure 3:
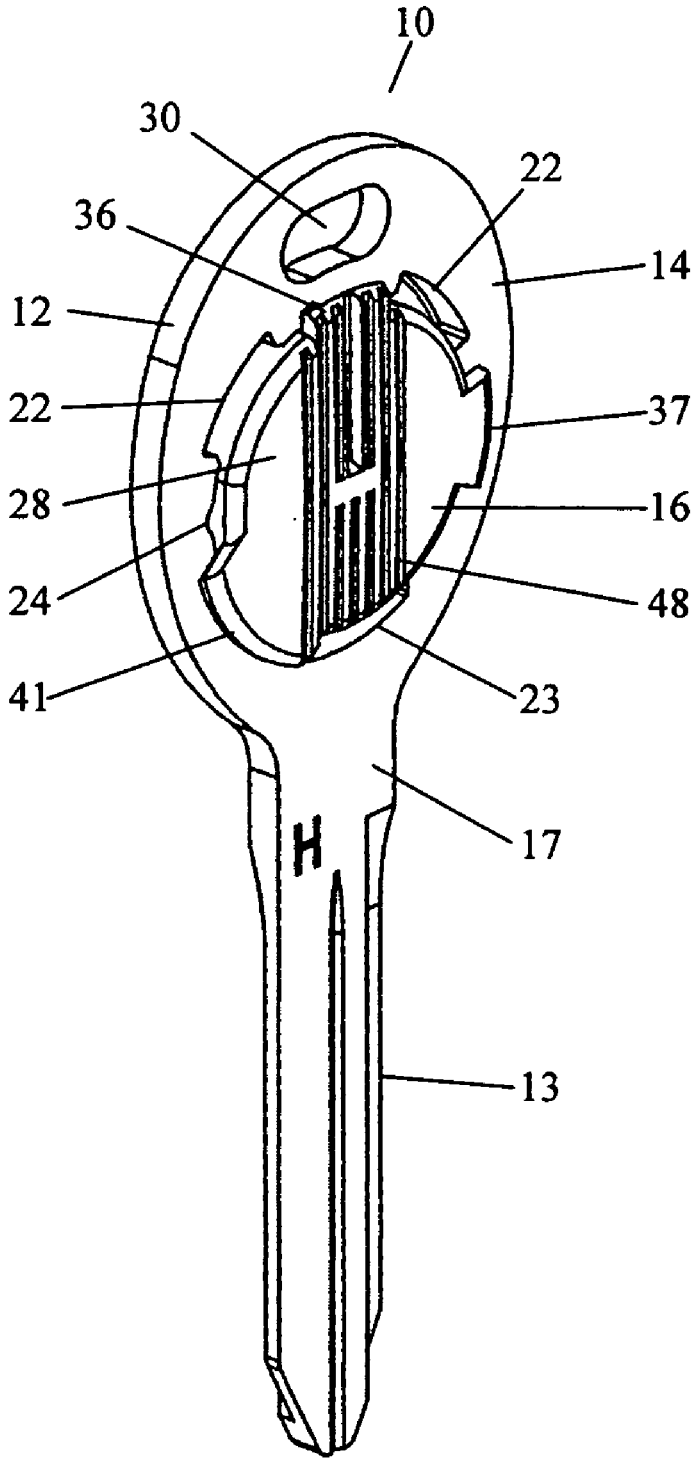
FIG. 3 is a perspective view of a shuttle inserted within a key shank aperture and rotated within the aperture in accordance with a preferred embodiment of the invention.
Figure 4:
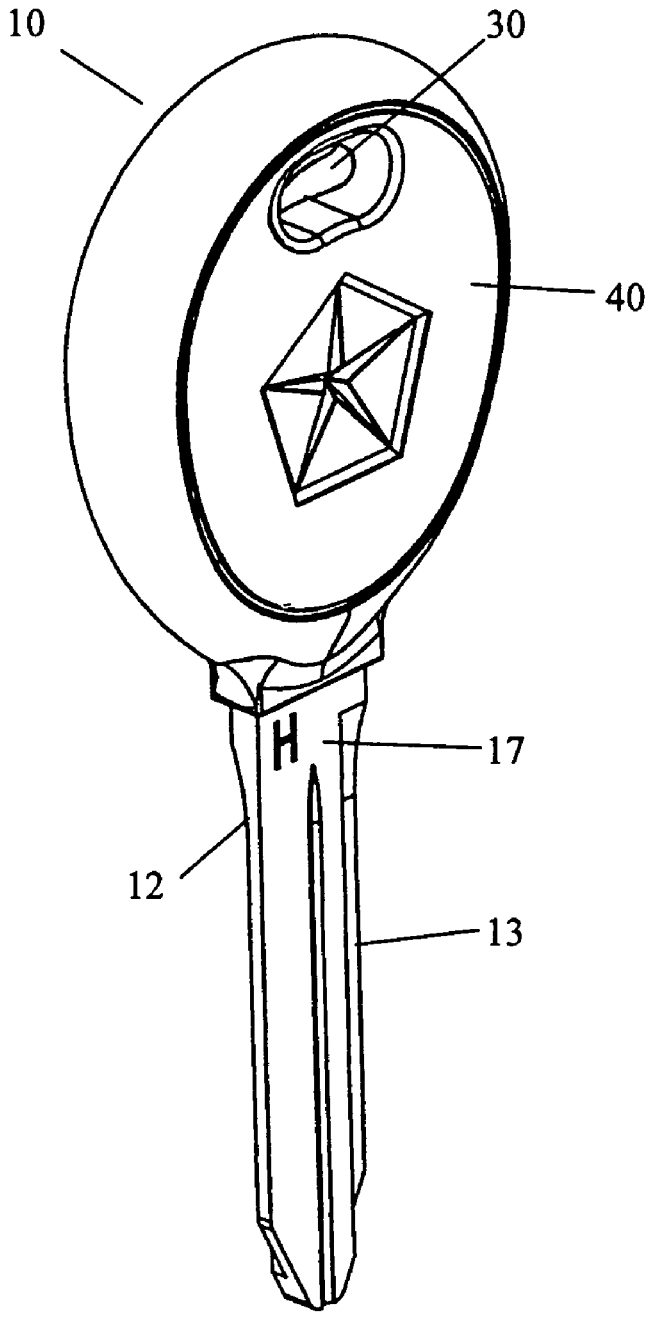
FIG. 4 is a perspective view of the key assembly with the key head formed about the key shank, shuttle, and transponder according to a preferred embodiment of the invention.
Figure 5D:
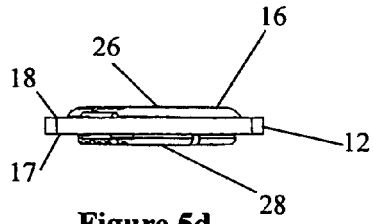
FIGS. 5*a–d* are side and end views of a shuttle inserted within the key shank aperture in accordance with a preferred embodiment of the invention.
Figure 5A:
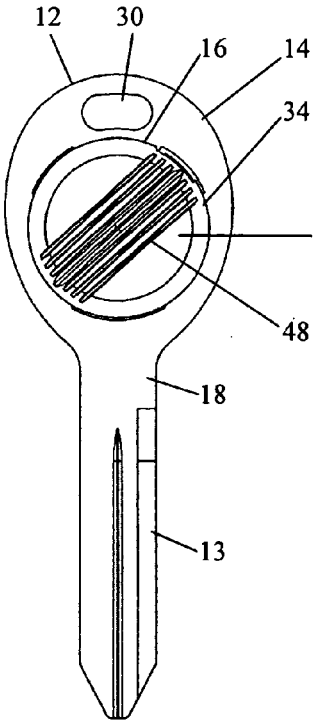
Figure 5B:
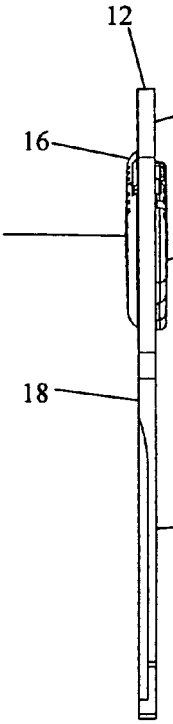
Figure 5C:
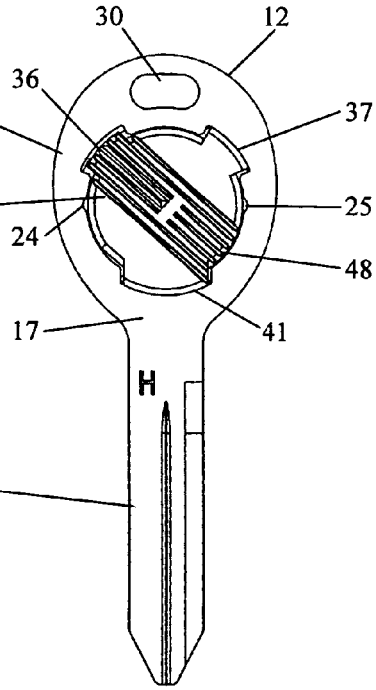
Figure 6D:
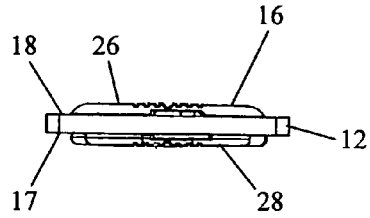
FIGS. 6*a–d* are side and end views of a shuttle inserted within a key shank aperture and rotated within the aperture in accordance with a preferred embodiment of the invention.
Figure 6A:
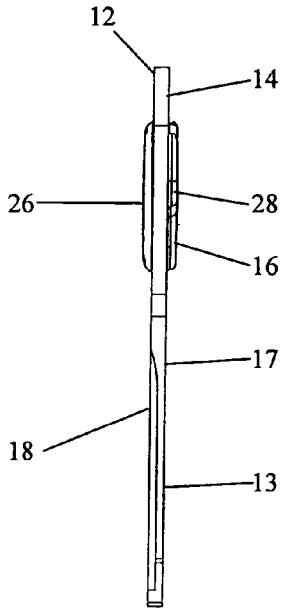
Figure 6B:
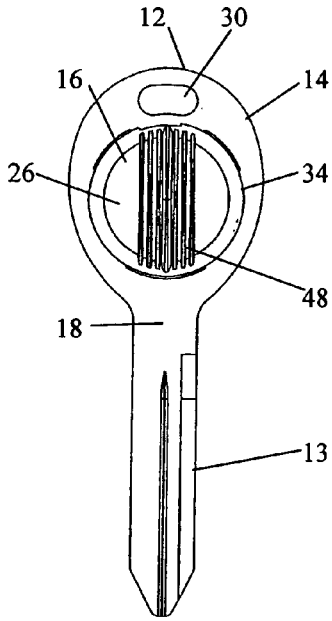
Figure 6C:
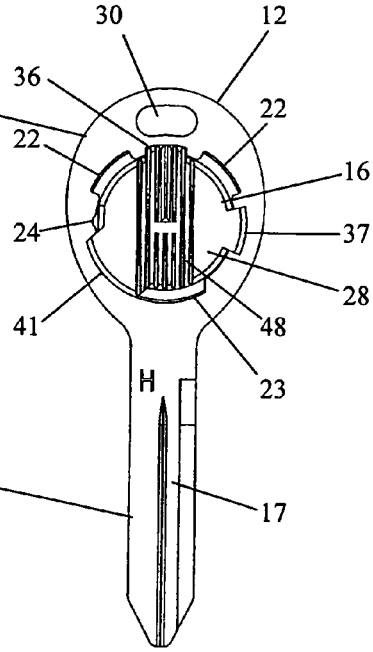
Figure 7A:
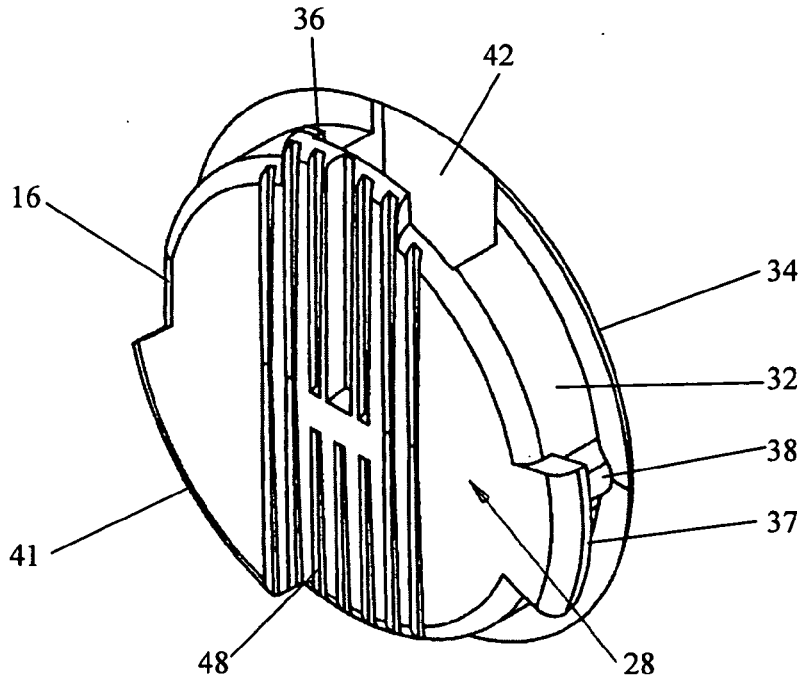
FIGS. 7*a–b* are perspective views of the shuttle in accordance with a preferred embodiment of the invention.
Figure 7B:
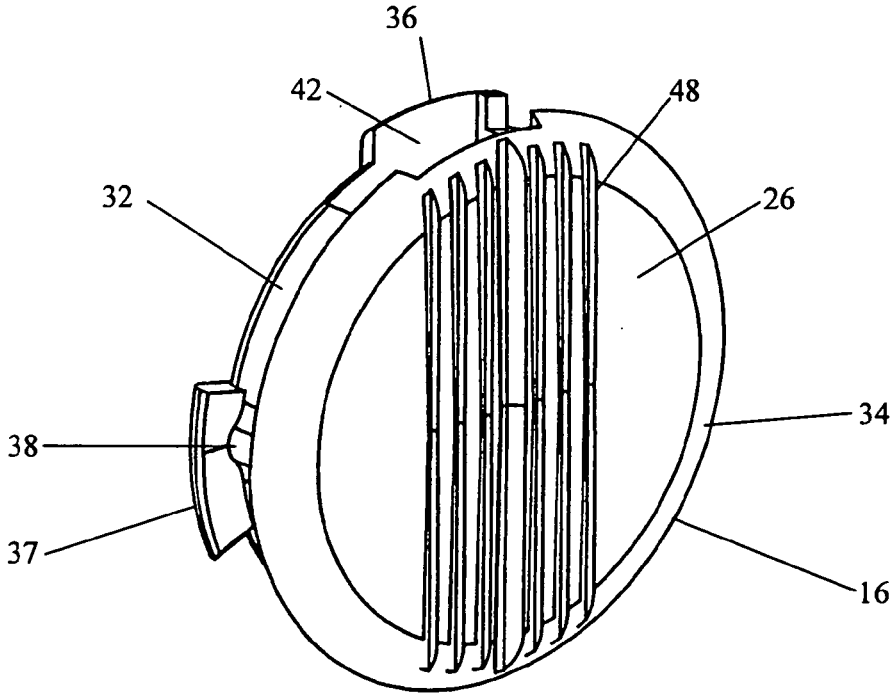
Figure 8C:
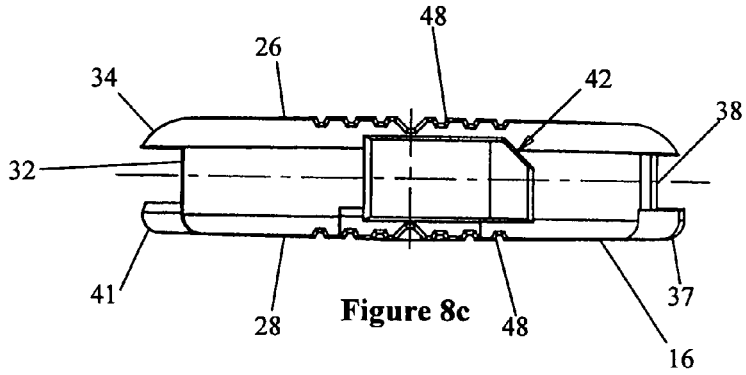
FIGS. 8*a–c* are side, top and end views of the shuttle in accordance with a preferred embodiment of the invention.
Figure 8A:
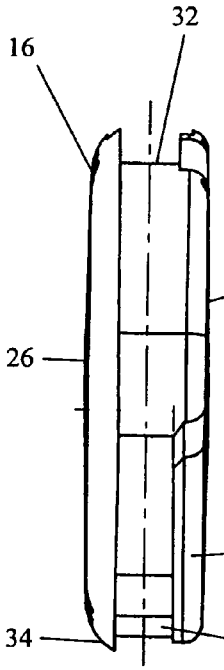
Figure 8B:
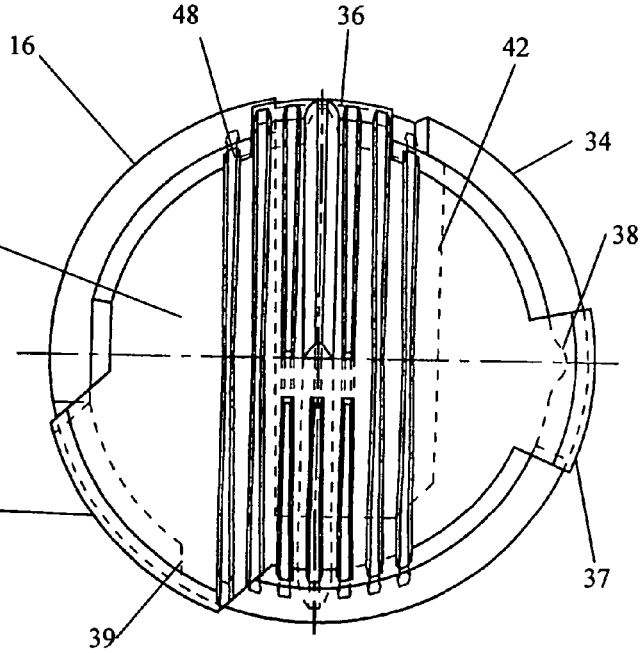
Figure 9:
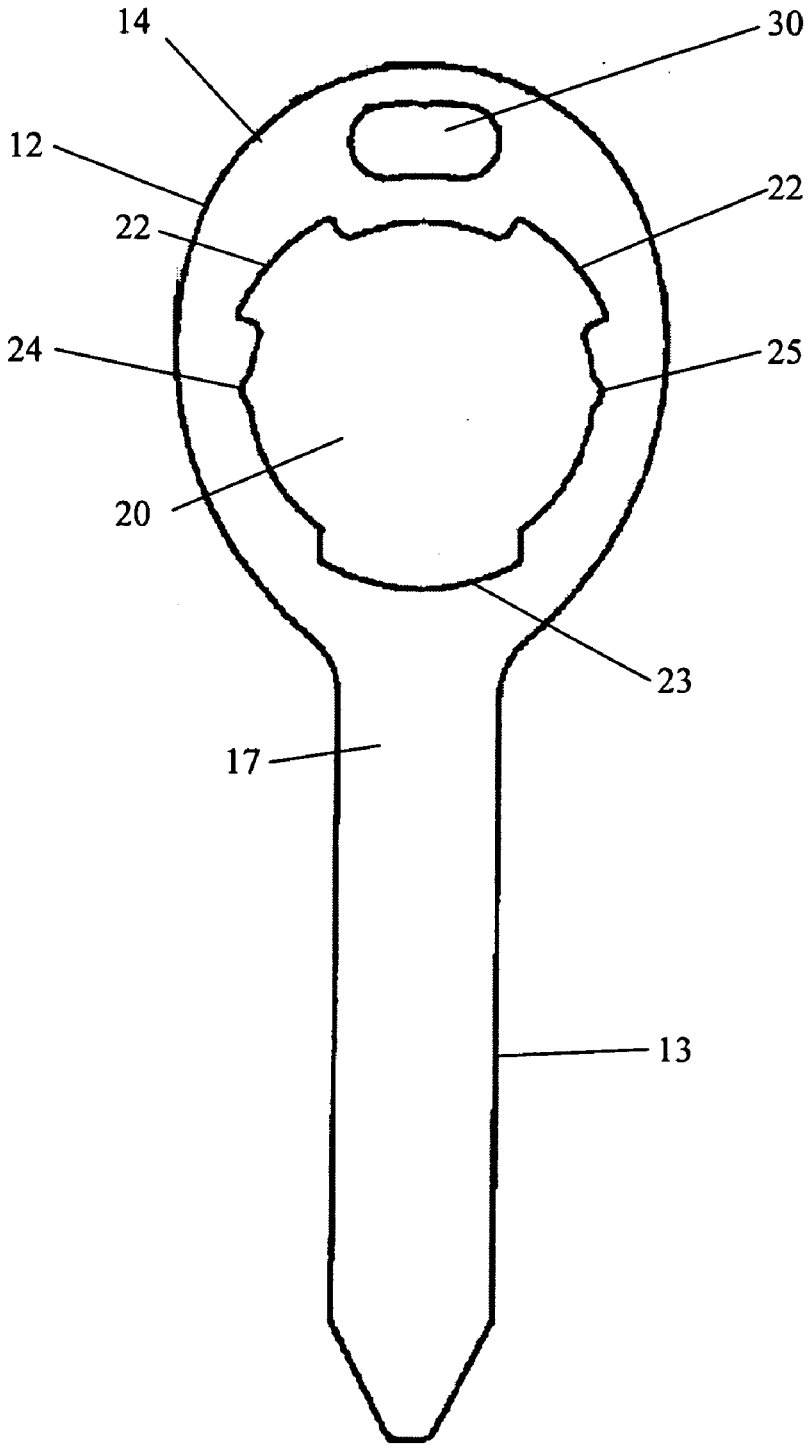
FIG. 9 is a side view of the key shank in accordance with a preferred embodiment of the invention.

As shown in FIGS. 1 and 4, the key 10 includes a shank 12, a shuttle 16, a transponder 50, and a head 40. Preferably, as shown in FIG. 9, a shank 12 includes a first side 17, a second side 18, a forward portion 13, and a handle portion 14. The forward portion 13 of the shank 12 is a key blade which engages a lock on a vehicle door. In alternate embodiments, the forward portion may have other features which engage a lock, or the shank 12 may have no forward portion.

The handle portion 14 includes a key ring aperture 30 for placing the key 10 on a key ring. Further, the handle portion 14 includes a shuttle receiving aperture 20 which is dimensioned to be slightly larger than the shuttle 16. Preferably, the shuttle receiving aperture 20 is substantially circular with a pair of first slots 22 and a second slot 23 which is larger than the first slots 22. The slots 22 and 23 extend outwardly from the perimeter of the shuttle receiving aperture 20 and, preferably, have a truncated pie shape. First and second indentations 24 and 25 also extend outwardly from the perimeter of the shuttle receiving aperture 20. The indentations 24 and 25 are located symmetrically about the centerline of the key 10.

As shown in FIGS. 7*a–b* and 8*a–c*, the shuttle 16 preferably has a substantially disc-like shape. The shuttle 16 may be fabricated from any suitable material, such as plastic. The shuttle has first and second substantially circular portions 26 and 28. A central portion 32 joins the first substantially circular portion 26 to the second substantially circular portion 28. A continuous flange 34 extends outwardly from the perimeter of the first substantially circular portion 26. The second substantially circular portion 28 has first and second keyed projections 36 and 37 and a third keyed projection 41, which is larger than the first and second keyed projections 36 and 37, extending outwardly from its perimeter. The keyed projections 36, 37, and 41 are preferably truncated pie shaped and are sized and configured to mate with the slots 22 and 23 extending from the shuttle receiving aperture 20 in the shank 12.

In a preferred embodiment, a locking projection 38 is located on the central portion 32 extending between the flange 34 and the second keyed projection 37. The locking projection is sized to lock into either of the indentations 24 and 25 on the shuttle receiving aperture 20. Also, a rotation stop 39 is located on the central portion 32 extending between the flange 34 and the third keyed projections 41.

A transponder recess 42 is located on the shuttle 16. The transponder recess 42 may be any one of a variety of types and shapes, and is preferably sized to tightly retain the transponder 50 so as to inhibit movement of the transponder 50 within the recess 42 and reduce the likelihood of damage when the transponder is exposed to mechanical shock. In a preferred embodiment, the transponder recess 42 is located substantially on the central portion 32 of the shuttle 16 and substantially extends between the flange 34 and first keyed projection 36. The transponder recess 42 has a rectangular opening with a chamfered corner and extends into the interior of the shuttle.

Preferably, the first and second substantially circular portions 26 and 28 have a substantially planar surface with a plurality of ridges 48 located on the planar surfaces. The ridges 48 provide improved grip for correctly positioning the shuttle.

The preferred method of assembling the key 10 is shown in FIGS. 1–4. First, the transponder 50 is placed in the transponder recess 42. As shown in FIGS. 2 and 5*a–d*, the shuttle 16 is correctly placed in the shuttle receiving aperture 20 by positioning the keyed projections 36, 37, and 41 so that they pass through the slots 22 and 23 on the perimeter of the shuttle receiving aperture 20. The shuttle 16 may be placed in the shuttle receiving aperture 20 from either the first side 17 or second side 18 of the shank 12. After passing the shuttle 16 through the shuttle receiving aperture 20, the flange 34 is located against one side of the shank 12.

Next, as shown in FIGS. 3 and 6*a–d*, the shuttle is rotated within the aperture to a position where the locking projection 38 is locked in position within an indentation 24 or 25 on the shuttle receiving aperture 20. If the shuttle 16 is inserted in the shuttle receiving aperture 20 from the first side 17 of the shank 12, the locking projection 38 locks in position in the first indentation 24. If the shuttle 16 is inserted in the shuttle receiving aperture 20 from the second side 18 of the shank 12, the locking projection locks in position in the second indentation 25. The rotation stop 39 prevents the shuttle 16 from rotating to a position where the locking projection 38 is located in the incorrect indentation. Therefore, the transponder 50 is consistently oriented in the proper position within the key 10, which is important to the proper operation of the electric interlock system.

After the shuttle 16 is located in the correct position, the flange 34 and the projections 36 are positioned against opposite sides of the shank 12 to hold the shuttle 16 in the shuttle receiving aperture 20. The shuttle 16 and shuttle receiving aperture 20 of the preferred embodiment insure that the transponder 50 is securely retained within the key 10.

As shown in FIG. 4, the key head 40 is formed about the forward portion 13 of the shank 12, the shuttle 16, and the transponder 50. In a preferred embodiment, the key head 40 is formed using a polymeric molding process. In a preferred polymeric molding process, the key head 40 is thermoformed by injection molding the key head 40 from a polymeric material (such as polyester or nylon) with the aid of a die. An alternative polymeric molding process utilizes a thermoset process of forming the key head 40 in place.

It will be appreciated that while the above preferred embodiment is directed to a key having a shank with a substantially circular aperture and a substantially circular, disc-like shuttle, the aperture and shuttle may be any of a variety of shapes which allow the shuttle to be inserted into the aperture and rotated into position so that the shuttle and transponder are retained in the key shank, with the transponder in the correct position. Further, there may be any number of mating slots and projections of any suitable shape on the shuttle and aperture.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A key assembly comprising:

a key shank comprising a handle portion, said handle portion having an aperture;

a shuttle including a first substantially planar portion having a first perimeter, a second substantially planar portion having a second perimeter, a central portion connected to the first and second substantially planar portions, and a transponder recess, wherein the shuttle and aperture on the handle portion of the key shank are configured and dimensioned so that the shuttle inserts into the aperture from either side of the key shank, mates with the aperture and rotates within the aperture, and after the shuttle mates with the aperture and rotates within the aperture the shuttle is securely retained in the aperture;

a transponder for receiving a wireless interrogation signal and transmitting a wireless response signal in response to the interrogation signal, wherein the transponder is located within the transponder recess; and a key head formed about said shuttle, transponder, and handle portion of the key shank.

2. The key assembly of claim 1, wherein the shuttle and key shank aperture are keyed to prevent improper orientation of the transponder.

3. The key assembly of claim 1, wherein the first and second substantially planar portions are substantially circular.

4. The key assembly of claim 1, wherein the first substantially planar portion includes a flange extending outwardly from the first perimeter.

5. The key assembly of claim 1, wherein the second substantially planar portion includes at least one keyed projection extending outwardly from the second perimeter.

6. The key assembly of claim 1, wherein the central portion includes a rotation stop.

7. The key assembly of claim 1, wherein the central portion includes a locking projection.

8. The key assembly of claim 1, wherein the first substantially planar portion includes a flange extending outwardly from a first perimeter, the second substantially planar portion includes at least one keyed projection extending outwardly from a second perimeter, and the central portion includes a rotation stop and a locking projection.

9. The key assembly of claim 1, wherein at least one of the substantially planar portions includes ridges for improved grip.

10. The key assembly of claim 1, wherein the key head is a polymeric material.

11. The key assembly of claim 10, wherein the key head is formed by an injection molding process.

12. A key assembly comprising:

a transponder for receiving a wireless interrogation signal and transmitting a wireless response signal in response to the interrogation signal;

a shuttle including:

a first substantially planar portion having a first perimeter;

a second substantially planar portion having a second perimeter;

a central portion connected to the first and second substantially planar portions, wherein a surface of the central portion extends between the first and second perimeters of the first and second substantially planar portions; and a transponder recess configured to securely retain the transponder within the shuttle;

a key shank having first and second sides and a forward portion and a handle portion, the key shank including an aperture in the handle portion having an interior perimeter which is slightly larger than the second perimeter of the shuttle second substantially planar portion whereby the shuttle may be placed in the aperture in the handle portion from either the first side or the second side of the key shank and the shuttle will rotate within the aperture to a secure position;

a key head formed about said shuttle, transponder, and handle portion of the key shank.

13. The key assembly of claim 11, wherein the shuttle is substantially disc shaped and the first and second substantially planar portions are substantially circular.

14. The key assembly of claim 11, further comprising a flange extending outwardly from the first perimeter of the first substantially planar portion.

15. The key assembly of claim 11, further comprising a plurality of projections extending outwardly from the second perimeter of the second substantially planar portion and a plurality of slots extending outwardly from the interior perimeter of the aperture, wherein the plurality of slots are configured and dimensioned to mate with the plurality of projections, so that the projections may be passed through the slots and the shuttle may be rotated to position the projections against a surface of the key shank to hold the shuttle in the aperture.

16. The key assembly of claim 11, further comprising a flange extending outwardly from the first perimeter of the first substantially planar portion, a plurality of projections extending outwardly from the second perimeter of the second substantially planar portion, and a plurality of slots extending outwardly from the interior perimeter of the aperture, wherein the plurality of slots are configured and dimensioned to mate with the plurality of projections, so that the projections may be passed through the slots and the shuttle may be rotated to position the projections and the flange against opposite sides of the key shank to hold the shuttle in the aperture.

17. The key assembly of claim 11, wherein a ridge is located on the central portion of the shuttle and first and second indentations extend outwardly from the interior perimeter of the aperture, wherein the indentations are located symmetrically about a centerline of the key shank at positions wherein the ridge secures in the first indentation if the shuttle is inserted into and rotated within the aperture from the first side of the key shank and wherein the ridge secures in the second indentation if the shuttle is inserted into and rotated within the aperture from the second side of the key shank, thereby holding the shuttle in a position such that the transponder is correctly aligned to properly receive and transmit signals.

18. The key assembly of claim 11, wherein a ridge is located on the center portion of the shuttle and acts as a rotation stop.

19. The key assembly of claim 11, wherein a plurality of gripping ridges are located on at least one of the substantially planar portions.

20. The key assembly of claim 11, wherein the transponder recess has an opening on the surface of the central portion of the shuttle and extends into an interior of the shuttle, the transponder recess extending between the first and second substantially planar portions.

21. A key assembly comprising:

a transponder for receiving a wireless interrogation signal and transmitting a wireless response signal in response to the interrogation signal;

a shuttle having a substantially disc shape, the shuttle including:

a first substantially circular planar portion having a first perimeter;

a flange extending outwardly from the first perimeter;

a second substantially circular planar portion having a second perimeter;

a plurality of truncated pie shaped projections extending outwardly from the second perimeter;

a central portion connected to the first and second substantially circular planar portions, wherein a surface of the central portion extends between the first and second perimeters of the first and second substantially circular planar portions;

a first ridge on the surface of the central portion having a first height, the first ridge extending between the flange and a truncated pie shaped projection;

a second ridge on the surface of the central portion having a second height less than the first height of the first ridge, the second ridge extending between the flange and a truncated pie shaped projection;

a transponder recess having an opening on the surface of the center portion and extending into an interior of the shuttle, the transponder recess extending between the first and second substantially circular planar portions and configured to securely retain the transponder within the shuttle; and a plurality of gripping ridges located on at least one of the substantially circular planar portions;

a key shank having a first and second side and a forward portion and a handle portion, the key shank including:

a substantially circular aperture in the handle portion having an interior perimeter which is slightly larger than the second perimeter of the second substantially circular planar portion;

a plurality of slots extending outwardly from the interior perimeter of the aperture, the plurality of slots configured and dimensioned to mate with the plurality of truncated pie shaped projections, so that the plurality of truncated pie shape projections may be passed through the plurality of slots and the shuttle may be rotated to position the projections and the flange against opposite sides of the key shank to hold the shuttle in the aperture; and first and second indentations extending outwardly from the interior perimeter of the aperture, the indentations located symmetrically about a centerline of the key shank at positions wherein the shuttle second ridge secures in the first indentation if the shuttle is inserted into and rotated within the aperture from the first side of the key shank and wherein the shuttle second ridge secures in the second indentation if the shuttle is inserted into and rotated within the aperture from the second side of the key shank, thereby holding the shuttle in a position such that the transponder is correctly aligned to properly receive and transmit signals; and a key head formed about said shuttle, transponder, and handle portion of the key shank.

* * * * *